US005672218A

United States Patent [19]

Schumacher

[11] Patent Number: 5,672,218

[45] Date of Patent: Sep. 30, 1997

[54] METHOD OF STRAIGHTENING METAL BARS HAVING EXTREMELY LOW LEVELS OF RESIDUAL STRESS AFTER STRAIGHTENING OPERATIONS ARE COMPLETED

[75] Inventor: Jon S. Schumacher, Fort Wayne, Ind.

[73] Assignee: Slater Steels Corporation, Fort Wayne, Ind.

[21] Appl. No.: 669,215

[22] Filed: Jun. 24, 1996

[51] Int. Cl.[6] ..... C21D 9/08; B21D 3/00

[52] U.S. Cl. ..... 148/597; 148/595; 72/341

[58] Field of Search ..... 72/129, 160, 341, 72/275; 148/595, 597

[56] References Cited

U.S. PATENT DOCUMENTS

| | | | |
|---|---|---|---|
| 1,205,998 | 11/1916 | Kenney . | |
| 2,748,038 | 4/1956 | Adair et al. . | |
| 3,082,132 | 3/1963 | Melill et al. . | |
| 3,094,442 | 6/1963 | Perry . | |
| 3,196,052 | 7/1965 | Hann . | |
| 3,210,221 | 10/1965 | Nachtman et al. . | |
| 3,508,978 | 4/1970 | Shuin et al. . | |
| 3,527,078 | 9/1970 | Lawson et al. | 72/160 |
| 4,216,666 | 8/1980 | Wu | 72/275 |
| 4,581,078 | 4/1986 | Jalil . | |
| 4,919,728 | 4/1990 | Kohl et al. . | |
| 5,284,534 | 2/1994 | Mendes . | |

FOREIGN PATENT DOCUMENTS

| | | | |
|---|---|---|---|
| 209712 | 12/1982 | Japan | 72/160 |
| 722966 | 3/1980 | U.S.S.R. | 148/597 |

*Primary Examiner*—Deborah Yee
*Attorney, Agent, or Firm*—Baker & Daniels

[57] ABSTRACT

Method of straightening a metal bar in which the metal bar is straightened by transporting the metal bar between a pair of rollers at a first straightening pressure. An outer layer portion of the metal bar is then removed in order to provide the metal bar with a reduced diameter and a substantially round cross-section. The metal bar is then again straightened by transporting the metal bar between a pair of rollers at a second straightening pressure. Subsequent to such straightening step, the metal bar desirably is heat treated under stress relieving conditions.

33 Claims, No Drawings

METHOD OF STRAIGHTENING METAL BARS HAVING EXTREMELY LOW LEVELS OF RESIDUAL STRESS AFTER STRAIGHTENING OPERATIONS ARE COMPLETED

FIELD OF THE INVENTION

The present invention relates to a method of straightening metal bars. More specifically, the present invention relates to a method of straightening metal bars comprising a sequence of straightening and heat treating steps which yield a straight bar with low levels of residual stress.

BACKGROUND OF THE INVENTION

Metal bars are used to fabricate a wide variety of articles. Stainless steel bars, in particular, are used to make articles for which high strength and corrosion resistance are desired. Examples of just a few of the many kinds of articles made from metal bars, such as stainless steel bars, include gun components, gears, valves, linkages, engine parts, equipment housings, drive shafts, turbine blades, firings, aircraft components, mechanical seals, pump impellers, and the like. In many applications, articles machined from metal bars are subject to strict tolerances. Such articles must be able to retain their machined dimensions without distorting. One factor affecting the dimensional stability of any such article fabricated from a metal bar is the dimensional stability of the metal bar itself.

Hot rolled metal bars tend to be relatively soft and must be thermally hardened in order to provide a bar with desired hardness and durability characteristics. The techniques used to thermally harden a metal bar vary depending upon the nature of the alloy from which the bar is formed. For example, to thermally harden a precipitation hardenable stainless steel bar, the bar is first solution annealed in order to uniformly distribute the precipitating element throughout the body of the bar, and then the bar is cooled to a temperature, e.g., ambient temperature at which the alloy system is supersaturated with the precipitating element. Hardening is then accomplished by an "aging" heat treatment which causes the precipitating element to precipitate as a secondary phase which pins the slip planes of the alloy, thus hardening and strengthening the bar. Lower aging temperatures create a finer precipitate and maximum hardness, whereas higher aging temperatures create a larger precipitate, resulting in lower hardness but better toughness.

As another example, to thermally harden a 400 series martensitic stainless steel bar, the bar is first austenitized and then rapidly cooled to a temperature below the martensitic transformation temperature of the alloy. This treatment provides a bar with maximum hardness and may be followed by a second "tempering" heat treatment which will lower the hardness, but improve the toughness of the bar. Thus, heating a precipitation hardenable stainless steel bar after cooling hardens such a bar, whereas heating a 400 series martensitic bar after cooling softens that kind of bar.

Thermal hardening tends to cause a metal bar to bow or warp, distorting away from a straightened condition. Therefore, after thermal hardening, the bar is desirably straightened before further use. Press straightening is one method applied for straightening metal bars. Press straightening comprises pressing the bar against two opposing support points. The yield strength of the alloy must be surpassed in order to accomplish straightening using this method. Press straightening is effective for nominally straightening metal bars, but is not effective on its own for straightening bars, particularly relatively high strength stainless steel bars, to exacting final tolerances. For example, press straightening is not effective for straightening metal bars according to an industry standard which limits bowing to a run-out, or distortion, away from a straightened condition of 1/16 inch (0.16 cm) or less over a 5 ft (1.5 m) length of a bar.

Rotary straightening is another method applied for straightening bars. Rotary straightening generally is accomplished by transporting the bar between the straightening rollers of a rotary straightening machine. A typical rotary straightening machine includes a pair of opposed straightening rollers disposed in the apparatus such that rotation of one or both of the rollers causes transport of the bar between the rollers. In most machines, one roller includes a concave surface for engaging the bar, and the other roller includes a convex surface for engaging the bar. As the bar is transported between the rollers, the convex surface of one roller forces the bar into the concave surface of the other roller. The bar is bent at a force beyond the yield strength of the bar into a straightened condition. Unlike press straightening, rotary straightening is capable of straightening bars to exacting final tolerances.

Rotary straightening machines, however, exert tremendous compressive force on the bar as the bar is transported between the straightening rollers. These forces add a substantial amount of stress to the bar, and a substantial portion of these stresses are added to the work hardened surface layer resulting from the rotary straightening operation. Conventional metal bars straightened using the rotary straightening approach tend to rely upon the residual stress in the bar in order to maintain straightness. Although such bars are adequately straight when made, non-uniform removal of the work hardened surface layer during subsequent machining operations can cause the bars to bow excessively. The greater the amount of the residual stress added to the bar during the straightening operation, the greater is the amount of distortion resulting from machining. Due to their relatively high strength, stainless steel bars are especially susceptible to greater amounts of distortion because so much stress must be added to such bars just to get the bars into a straightened condition.

What is needed in the art is a process for straightening metal bars, particularly stainless steel bars, which minimizes residual stress in the work hardened surface of the bar as straightening is accomplished.

SUMMARY OF THE INVENTION

The present invention provides a method of straightening metal bars which minimizes residual stress remaining in the work-hardened surface layer portion of the bars yet produces bars with excellent straightness characteristics. In accordance with the process of the present invention, the straightness characteristics of metal bars are improved by a method which incrementally reduces residual stresses in the metal bars as the bars are subjected to straightening operations. As a result, metal bars of the present invention are characterized by extremely low levels of residual stress after straightening and thereby remain much straighter after machining operations, even after non-uniform removal of the surface layer.

In one aspect, the present invention provides a method of straightening a metal bar comprising a sequence of at least three process steps. The metal bar is straightened by transporting the metal bar between a pair of rollers at a first straightening pressure. An outer layer portion of the metal bar is then removed in order to provide the metal bar with a reduced diameter and a substantially round cross-section. The metal bar is then again straightened by transporting the metal bar between a pair of rollers at a second straightening pressure.

In another aspect, the present invention provides a method of straightening a thermally hardenable metal bar. The bar is provided and subjected to a heat treating operation in order to thermally harden the bar. The thermally hardened bar is straightened at a first straightening pressure after which an outer layer portion of the straightened metal bar is removed in order to provide the bar with a reduced diameter and a substantially round cross-section. After this, the metal bar is straightened a second time at a second straightening pressure, wherein the second straightening pressure is less than the first straightening pressure. Subsequent to the second straightening step, the metal bar is heat treated under stress relieving conditions.

In another aspect, the present invention provides a method of straightening a metal bar in which the metal bar is subjected to a first heat treating operation effective to increase the hardness of the metal bar. Subsequent to the first heat treating step, the bar is subjected to a first straightening operation which comprises:

(i) rotary straightening the metal bar at a first straightening pressure, and (ii) removing an outer surface layer portion of the metal bar in order to provide the metal bar with a reduced diameter and a substantially round cross section.

Subsequent to this, the metal bar is subjected to a second heat treating operation.

The method of the present invention includes a unique combination and sequence of processing steps which provides metal bars having extremely low levels of residual stress after straightening operations are completed. The process includes a combination of at least three important features. Firstly, the present invention subjects a bar to a sequence of at least two straightening steps, wherein a later straightening step occurs at a straightening pressure less than that of an earlier straightening step. Second, an outer surface layer of the bar is removed in a turning step which occurs between the first and second straightening steps. Advantageously, such turning not only reduces the diameter of the bar and provides the bar with a substantially round cross-section, but turning also removes a substantial portion of stresses added to the bar during the first straightening step. Third, the second straightening step is followed by a subsequent heat treating step to further remove stresses added to the bar by straightening operations.

Thus, practicing the combination and sequence of process steps of the present invention advantageously yields a straight bar with minimal residual stress. While the sequence of one or more process steps of the present invention is important, additional process steps may nonetheless be incorporated into the claimed process, either before, interposed between, or after, the recited steps, as desired, and as will be further described below with respect to representative embodiments of the present invention.

DETAILED DESCRIPTION OF THE PREFERRED EMBODIMENTS

The following detailed description will describe the present invention primarily with respect to the treatment of precipitation hardenable stainless steel bars and tempered, martensitic stainless steel bars, but the utility of the present invention is not to be so limited. The processing techniques of the present invention may be applied to bars made from any other grade of stainless steel or any other kind of metal. Metal bars straightened in accordance with the present invention may be advantageously used in any application for which the use of bars which retain a high level of straightness is desired. Examples of such applications include the fabrication of gun components, gears, valves, linkages, engine parts, equipment housings, drive shafts, turbine blades, fittings, aircraft components, mechanical seals, pump impellers, and the like.

In the practice of the present invention, a metal bar to be straightened, which typically may be in a hot rolled condition, is provided. Preferably, in those embodiments of the invention described below in which surface portions of the bar will be removed in order to reduce the diameter of the bar, such a hot rolled bar is provided with a diameter which is oversized relative to the desired final diameter of the bar. Generally, any amount of convenient oversizing may be used that is convenient and/or practical. However, if the oversizing is too great, then a substantial amount of material will need to be removed from the bar in order to arrive at the desired final diameter. This would waste material, cause more wear on tooling, and add cost to the manufacturing process. On the other hand, if the oversizing is too small, it may be difficult to remove enough of the work hardened surface resulting from rotary straightening without reducing the diameter of the bar too much. Balancing these concerns, providing a bar which is oversized by an amount in the range from about 1/16 inch (0.16 cm) to about 2 inches (5.1 cm), preferably 1/16 inch (0.12 cm) to 1 inch (2.5 cm), and more preferably 1/16 inch (0.16 cm) to ½ inch (1.3 cm) would be suitable in the practice of the present invention.

Desirably, the hot rolled bar may be subjected to a first heat treating operation, which is intended to harden or temper the bar, before straightening operations are carried out. Conditions for conducting the heat treating operation used for any particular bar will depend upon a variety of factors, including the composition of the bar, the desired properties of the finished product, the bar diameter, the final straightness requirements, and the like. In carrying out the heat treating operation, one skilled in the art may select one or more appropriate heat treating steps and, if desired, one or more cooling steps, in accordance with conventional practices.

As one example of a preferred heat treating operation suitable for use with precipitation hardenable stainless steel bars of the standard AISI 630 grade, the metal bar is first solution annealed. The term "solution annealing" as it applies to precipitation hardenable stainless steels, refers to a relatively high temperature heat treatment intended to ensure that substantially all alloying and precipitating elements in the material are uniformly dispersed within the iron matrix of the material. During solution annealing, the material system typically exists as a solid solution. Preferably, solution annealing of such bars comprises heat treating the bars at a temperature in the range of from about 1500° F. (810° C. ) to about 2000° F. (1100° C.), more preferably about 1800° F. (980° C. ) to about 2000° F. (1100° C.), for a in the range from 100 seconds to 48 hours, more preferably 1 to 10 hours.

As an option, the bar may be overaged prior to solution annealing. The term "overaging"refers to a heat treatment in which a bar is thermally treated for a desired period of time at a desired temperature in order to cause agglomeration and growth of the particles of the precipitating element. The larger particles are not as effective at hardening the material as smaller particles. Thus, the larger particles yield a material which is lower in hardness but higher in toughness, thereby offering easier fabrication of articles from the material. Overaging the bar prior to solution annealing tends to make solution annealing more effective. Preferably, overaging of the bar comprises heat treating the bar at a temperature in the range from 900° F. (480° C.) to 1400° F. (760° C.), more preferably 1150° F. (620° C.) to 1300° F. (700° C.), for a time period in the range from 100 seconds to 48 hours, more preferably 4 hours to 12 hours.

After solution annealing, the precipitation hardenable stainless steel bar is cooled to a temperature below about 90° F. (32° C.). Cooling is followed by age hardening. Age hardening refers to a relatively low temperature heat treatment used to harden the material and is synonymous with the term "precipitation hardening". During age hardening, a precipitate of a secondary phase forms within the material matrix, strengthening and hardening the material by restricting deformation which may occur along crystalline slip planes. Age hardening is generally accomplished at a temperature in the range of 900° F. (480° C.) to 1400° F. (760° C.) for a period in the range of 1 to 8 hours.

Generally, the degree of hardening resulting from age hardening can be controlled by selection of the temperature at which age hardening is carried out. Hardening is at a maximum at about 900° F. (480° C.) with higher temperatures giving lower hardness, but better toughness. In the practice of the present invention, conventional practices may be used to select appropriate age hardening conditions to achieve desired physical properties of the material.

As another example of a heat treating operation suitable for use with martensitic stainless steel bars which are hardened by tempering, the bar may be hardened by rapidly cooling the bar from an austenitizing temperature, typically 1600° F. (870° C.) to 1950° F. (1070° C.), to a temperature below the martensite transformation temperature, typically a temperature in the range of from ambient temperature to about 300° F. (150° C.). Such cooling yields a material with maximum hardness and may be accomplished using any suitable cooling technique such as air cooling or oil quenching. After cooling, the bar is then usually tempered under conditions effective to achieve desired hardness characteristics for the bar. As an example of tempering conditions found to be suitable for tempering a martensitic stainless steel bar of the 410 grade, suitable tempering comprises heat treating the bar at a temperature in the range from 1150° F. (620° C.) to 1400° F. (760° C.), preferably 1150° F. (620° C.) to 1300° F. (700° C.) for a time period of 100 seconds to 48 hours, preferably 4 hours to 10 hours.

After the first heating treating operation is completed, the resulting hardened bar is then subjected to a first straightening operation. As a preferred initial step of the straightening operation, the bar may be press straightened between press straightening members in order to nominally straighten the bar and remove the relatively larger bows of the bar. Press straightening advantageously reduces the amount of force required to straighten the bar to final tolerances in subsequent steps of the invention, which in turn reduces the amount of residual stress imparted to the bar by those subsequent steps.

Press straightening is accomplished under conditions effective to nominally straighten the bar, while being careful not to use too much pressure. Using too much pressure to press straighten may offer little added benefit relative to press straightening at relatively lower pressures. Additionally, press straightening with a pressure which is too great may tend to add an unnecessary amount of residual stress to the bar. Appropriate press straightening conditions will depend upon a variety of factors, including the type of bar being press straightened, the degree of bowing of the bar being press straightened, the type of apparatus being used, and the like. Generally, appropriate press straightening conditions may be selected by one of ordinary skill in the art in accordance with conventional practices.

After the press straightening step, if any, the bar is then rotary straightened to desired tolerances. In the practice of the present invention, rotary straightening is preferably accomplished by transporting the bar between the straightening rollers of a rotary straightening machine. Roller straightening machines are widely known in the art and any could be used in the practice of the present invention. One example of a suitable roller straightening machine is the Number 6 machine commercially available from Meeco, Inc., St. Louis, Mo.

After rotary straightening, an outer surface layer portion of the bar is removed in order to provide the bar with a reduced diameter and a substantially round cross-section. Generally, during the material removal step, a sufficient amount of material is removed from the bar in order to reduce the bar to its desired final diameter. For example, if the bar is ⅛ inch (0.32 cm) oversized, then 1/16 inch (0.16 cm) is removed from the surface of the bar in order to reduce the overall diameter of the bar by ⅛ inch (0.32 cm). In preferred embodiments, a sufficient amount of material is removed from the bar such that at least a portion, of the work hardened surface layer resulting from rotary straightening is removed from the bar. Because a substantial portion of the stress added to the bar resides in the work hardened surface layer, the material removal step advantageously eliminates a portion of the residual stress imparted to the bar by the rotary straightening step. Preferably, material removal is accomplished by turning the bar. Turning comprises feeding the bar through a rotating chuck containing tooling capable of removing the surface layer portion of the bar by cutting, scraping, abrading, or the like, as the chuck rotates. Turning machines are widely known in the art, and any may be used in the practice of the present invention. One example of a suitable turning machine is the Number 6 Medart Rough Turning Machine commercially available from the Medart Company, Pittsburgh, Pa.

As a result of the material removal step, the bar may tend to distort away from the straightened condition provided by the first rotary straightening step. Accordingly, the bar is desirably subjected to a second rotary straightening step after material removal in order to remove such distortion. However, the degree of distortion resulting from the material removal step is typically much less than the degree of original distortion of the bar prior to the first rotary straightening step. Less pressure, therefore, is required to straighten the bar during the second rotary straightening step as compared to the first rotary straightening step. Additionally, after the material removal step, the bar will have a more uniform, substantially rounder cross-section than the bar had during the first rotary straightening step. This, too, is another factor which allows less pressure to be used to straighten the bar during the second rotary straightening step.

Accordingly, the second rotary straightening step occurs at a straightening pressure which is less than the straightening pressure of the first straightening step. Generally, in the practice of the present invention, the ratio of the straightening pressure of the second rotary straightening step to the straightening pressure of the first rotary straightening step is in the range of from 0.1 to 0.9, preferably 0.3 to 0.7, and more preferably about 0.5. Because the second rotary straightening step uses a lower straightening pressure than the first rotary straightening step, the second rotary straightening step adds less residual stress to the bar than does the first rotary straightening step.

After the second rotary straightening step, the bar is then heat treated under stress relieving conditions. Such heat treating is intended to reduce at least a portion of the residual stress in the bar remaining from the previous straightening operation. Although aging may be carried out under any conditions suitable for reducing the residual stress of the bar, it is preferred that aging is carried out trader conditions effective to eliminate substantially all of the residual stress added to the bar during the second rotary straightening step. Conditions for conducting the stress relieving aging treatment for any particular bar will depend upon a variety of factors, including the composition of the bar, the desired properties of the finished product, the bar diameter, the final straightness required, and the like. In carrying out the aging, one skilled in the art may select aging conditions in accordance with conventional practices. Generally, for precipitation hardened stainless steel bars or martensitic stainless steel bars, aging preferably comprises heat treating the bar at a temperature in the range from about 900° F. (480° C.) to about 1400° F. (760° C.), preferably 1000° F. (540° C.) to 1300° F. (700° C.), for a period of 100 seconds to 48 hours, preferably 4 hours to 10 hours. In any case, it is preferred that such heat treatment be carried out at a temperature which is less than or equal to the temperature at which the bar was age hardened, or tempered, as appropriate. More preferably, the temperature of the stress relieving heat treatment is carried out at a temperature which is substantially the same as the temperature at which the bar was age hardened, or tempered, as appropriate.

It is possible that the final stress relieving heat treatment may result in a very minor amount of distortion to the bar. Accordingly, as an option, the bar may be press or bump straightened after the stress relieving heat treatment in order to remove any such distortion. The force required for any such press or bump straightening is minimal enough such that very little residual stress is added to the bar by such straightening, and the straightness characteristics of the bar are not adversely affected in any significant way.

After treatment in accordance with the present invention, the resultant bar will be characterized by extremely stable straightness characteristics. For example, metal bars having a final diameter of 5.25 inches which have been treated in accordance with the straightening process of the present invention have distorted less than 1/16 inch (0.04 cm) over a 5 ft (1.5 m) length of the bar, even after the bar is subjected to machining operations which nonumiformly remove surface portions of the bar.

The present invention will now be further described with respect to the following examples.

EXAMPLE 1

In order to prepare a 5.25 inch (13.3 cm) round, 25 foot long (7.5 m), standard AISI 630 grade, precipitation hardened stainless steel bar, a 5.5 inch (14 cm) hot rolled bar of such grade was first overaged at 1250° F. (677° C.) for 6 hours. The overaged bar was solution annealed at 1900° F. (1038° C.) for four hours and then air cooled to ambient temperature. The bar was then age hardened at 1150° F. (620° C.) for 4 hours. After this initial heat treating operation comprising overaging, solution annealing, and age hardening, the resultant hardened bar was then press straightened to nominally straighten the bar. The bar was then straightened on a #6 Meeco two roll, rotary straightening machine by applying 800 psi (5500 kPa) of pressure. During rotary straightening, the concave roll was set at 18 degrees, and the convex roll was set at 17 degrees. The bar was straightened to a tolerance of 1/16 inch (0.16 cm) of distortion or less over a 5 ft (1.5 m) length of the bar. After this straightening step, the bar was mined on a #6 Medart Rough Turning machine to a 5.26 inch (13.4 cm) diameter, thereby removing a portion of the work hardened layer resulting from the rotary straightening step. Turning was accomplished by rotating the cutting head at 160 rpm and by moving the bar through the cutting head at 1.5 ft/min (0.5 m/min). After turning, the bar was restraightened on the #6 Meeco machine as described above, except that this second time, only 400 psi (2750 kPa) of pressure was applied. As a consequence of restraightening, the bar was returned to a straightness of better than 1/16 inch (0.16 cm) over a 5 ft (1.5 m) length of the bar. To remove residual stresses resultant from the restraightening operation, the bar was heat treated at 1150° F. (620° C.) for four hours. This heat treatment resulted in a slight bowing of the bar. The bar was returned to a straightness of better than 1/16 inch (0.16 cm) over a 5 ft (1.5 m) length of the bar by press straightening. All press straightening, turning, and rotary straightening steps were carried out under ambient conditions.

Subsequent to this straightening procedure, the bar was machined along its full length, resulting in a bar with a nonuniform cross section across its length. Notwithstanding such machining, the bar retained its straightness.

EXAMPLE 2

In order to prepare a 5.25 inch (13.3 cm) round, 25 foot long (7.5 m), martensitic stainless steel bar, a 5.5 inch (14 cm) hot rolled bar of such grade was heat treated at an austenitizing temperature of 1900° F. (1038° C.) for four hours and then air cooled to ambient temperature. The bar was then tempered at 1300° F. (704° C.) for 4 hours. After this initial heat treating operation, the resulting hardened bar was then press straightened to nominally straighten the bar. The bar was then straightened on a #6 Meeco two roll, rotary straightening machine by applying 800 psi (5500 kPa) of pressure. During rotary straightening, the concave roll was set at 18 degrees, and the convex roll was set at 17 degrees. The bar was straightened to a tolerance of 1/16 inch (0.16 cm) of distortion or less over a 5 ft (1.5 m) length of the bar. After this straightening step, the bar was turned on a #6 Medart Rough Turning machine to a 5.26 inch (13.4 cm) diameter, thereby removing a portion of the work hardened layer resulting from the rotary straightening step. Turning was accomplished by rotating the cutting head at 160 rpm and by moving the bar through the cutting head at 1.5 ft/min (0.5 m/min). After turning, the bar was restraightened on the #6 Meeco machine as described above, except that this second time, only 400 psi (2750 kPa) of pressure was applied to the rollers. As a consequence of restraightening, the bar was returned to a straightness of better than 1/16 inch (0.16 cm) over a 5 ft (1.5 m) length of the bar. To remove residual stresses resultant from the restraightening operation, the bar was heat treated at 1250° F. (677° C.) for four hours. This heat treatment resulted in a slight bowing of the bar. The bar was returned to a straightness of better than 1/16 inch (0.16 cm) over a 5 ft (1.5 m) length of the bar by press straightening. All press straightening turning and rotary straightening steps were carried out under ambient conditions.

Subsequent to this straightening procedure, the bar was machined along its full length, resulting in a bar with a nonuniform cross section across its length. Notwithstanding such machining, the bar retained its straightness.

COMPARISON EXAMPLE A

In order to prepare a 5.25 inch (13.3 cm) round, 25 foot long (7.5 meter), standard AISI 630 grade, precipitation hardened stainless steel bar, a 5.5 inch (14 cm) hot rolled bar of such grade was first overaged at 1250° F. (677° C.) for 6 hours. The bar was then solution annealed at 1900° F. (1048° C.) for 4 hours, cooled to ambient temperature, and then age hardened at 1150° F. (621° C.) for 4 hours. The bar was then rotary straightened on a No. 6 Mecco roller straightening machine and turned on a #6 Medart Rough Turning machine to a diameter of 5.280 inches (14.41 cm).

The resultant bar was then machined in a manner identically to the manner in which the bar of Example 1 was machined. Unlike the bar of Example 1, however, this bar bowed, or distorted, away from straightness by as much as 0.25 inches (0.64 cm) over a 5 ft length of the bar.

Other embodiments of this invention will be apparent to those skilled in the art from a consideration of this specification or from practice of the invention disclosed herein. Various omissions, modifications, and changes to the principles described herein may be made by one skilled in the art without departing from the true scope and spirit of the invention which is indicated by the following claims.

What is claimed is:

1. A method of straightening a metal bar having a longitudinal axis, comprising the steps of:

(a) straightening the metal bar by transporting the metal bar between a pair of rollers at a first straightening pressure;

(b) removing an outer layer portion of the straightened metal bar in order to provide the metal bar with a reduced diameter and a substantially circular cross-section;

(c) straightening the metal bar by transporting the metal bar between a pair of rollers at a second straightening pressure, wherein the second straightening pressure is less than the first straightening pressure.

2. The method of claim 1, wherein the metal bar comprises a precipitation hardened stainless steel alloy.

3. The method of claim 1, wherein the metal bar comprises a martensitic stainless steel alloy.

4. The method of claim 1, wherein the ratio of the second straightening pressure to the first straightening pressure is in the range from about 0.1 to about 0.9.

5. The method of claim 4, wherein the ratio of the second straightening pressure to the first straightening pressure is in the range from about 0.3 to 0.7.

6. The method of claim 1, further comprising, prior to said first straightening step, press straightening the metal bar.

7. The method of claim 1, wherein the removing step comprises the steps of feeding the bar through a rotating chuck comprising tooling capable of removing the surface portion of the bar.

8. A method of straightening a thermally hardenable metal bar having a longitudinal axis, comprising the steps of:

(a) providing the thermally hardenable metal bar;

(b) subjecting the metal bar to a heat treating operation in order to thermally harden the bar;

(c) straightening the thermally hardened metal bar at a first straightening pressure;

(d) removing an outer layer of the straightened metal bar in order to provide the metal bar with a reduced diameter and a substantially circular cross-section;

(e) subsequent to the removing step, straightening the metal bar a second time at a second straightening pressure, wherein the second straightening pressure is less than the first straightening pressure; and (f) subsequent to the second straightening step, heat treating the metal bar under stress relieving conditions.

9. The method of claim 8, wherein the metal bar provided in step (a) comprises a precipitation hardenable stainless steel alloy.

10. The method of claim 9, wherein the step of subjecting the metal bar to a heat treating operation comprises solution annealing the metal bar, cooling the solution annealed metal bar to a temperature below about 90° F., and age hardening the metal bar under conditions effective to adjust the hardness of the metal bar.

11. The method of claim 10, further comprising the step of, prior to solution annealing, overaging the metal bar.

12. The method of claim 11, wherein said overaging step occurs at a temperature in the range from about 900° F. to 1400° F. for a time in the period of from about 100 seconds to about 48 hours.

13. The method of claim 10, wherein the age hardening step comprises heating the metal bar at a temperature in the range from about 900° F. to about 1400° F. for a period of from about 100 seconds to about 48 hours.

14. The method of claim 10, wherein the step of solution annealing the metal bar comprises heating the metal bar at a temperature in the range from about 1500° F. to about 2000° F. for a period of from about 100 seconds to about 48 hours.

15. The method of claim 8, wherein the ratio of the second straightening pressure to the first straightening pressure is in the range from about 0.1 to about 0.9.

16. The method of claim 8, wherein the first straightening step comprises straightening the metal bar by transporting the metal bar between a pair of rollers.

17. The method of claim 8, wherein the second straightening step comprises straightening the metal bar by transporting the metal bar between a pair of rollers.

18. The method of claim 8, wherein each of the first and second straightening steps comprises straightening the metal bar by transporting the metal bar between a pair of rollers.

19. The method of claim 18, wherein the ratio of the second straightening pressure to the first straightening pressure is in the range from about 0.1 to about 0.9.

20. The method of claim 18, wherein the ratio of the second straightening pressure to the first straightening pressure is in the range from about 0.3 to 0.7.

21. The method of claim 8, further comprising, prior to said first straightening step, press straightening the metal bar.

22. The method of claim 8, wherein the removing step comprises the steps of feeding the bar through a rotating chuck comprising tooling capable of removing the surface portion of the bar.

23. The method of claim 8, wherein the metal bar provided in step (a) comprises a martensitic stainless steel alloy.

24. The method of claim 23, wherein the step of subjecting the metal bar to a heat treating operation comprises austenitizing the metal bar, cooling the austenitized metal bar to a temperature below the martensitic transformation temperature of the bar, and tempering the bar under conditions effective to adjust the hardness of the bar.

25. The method of claim 24, wherein the tempering step comprises heating the metal bar at a temperature in the range from about 1000° F. to about 1400° F. for a period of from about 100 seconds to about 48 hours.

26. The method of claim 24, wherein the step of austenitizing the metal bar comprises heating the metal bar at a temperature in the range from about 1500° F. to about 2000° F. for a period of from about 100 seconds to about 48 hours.

27. The method of claim 24, wherein the cooling step comprises cooling the metal bar to a temperature below about 300° F.

28. A method of straightening a metal bar, comprising the steps of:

(a) subjecting the metal bar to a first heat treating operation effective to increase the hardness of the metal bar;

(b) subsequent to said first heat treating operation, subjecting the metal bar to a first straightening operation, wherein said first straightening operation comprises:

(i) rotary straightening the metal bar at a first straightening pressure;

and (ii) removing an outer surface layer portion of the metal bar in order to provide the metal bar with a reduced diameter and a substantially round cross section; and (c) subsequent to said first straightening operation, subjecting the metal bar to a second heat treating operation.

29. The method of claim 28, further comprising the step of, after the second heat treating operation, subjecting the metal bar to a second straightening operation.

30. The method of claim 29, wherein the second straightening operation comprises press straightening the metal bar.

31. The method of claim 28, wherein the first straightening operation further comprises, subsequent to the turning step, rotary straightening the bar at a second straightening pressure.

32. The method of claim 31, wherein the second straightening pressure is less than the first straightening pressure.

33. The method of claim 28, wherein the first straightening operation further comprises press straightening the bar prior to any rotary straightening of the bar.

* * * * *